United States Patent [19]

Hansel

[11] 4,040,458

[45] Aug. 9, 1977

[54] GASOLINE TANK FILLPIPE ADAPTER

[75] Inventor: William B. Hansel, Media, Pa.

[73] Assignee: Sun Oil Company of Pennsylvania, Philadelphia, Pa.

[21] Appl. No.: 575,109

[22] Filed: May 6, 1975

[51] Int. Cl.[2] ..... B65B 3/04

[52] U.S. Cl. ..... 141/392; 141/DIG. 1; 220/86 R

[58] Field of Search ..... 141/312, 392, 325, 311, 141/383, 390, 391, 59, 97, 290, 310, 367, 382, 384–388, 351, DIG. 1, 44, 52, 39–43, 350; 220/86 R, 85 F; 285/27, 177, 263, 272

[56] References Cited

U.S. PATENT DOCUMENTS

| | | | |
|---|---|---|---|
| 3,872,900 | 3/1975 | Götz | 141/392 |
| 3,880,317 | 4/1975 | Arnett | 141/392 |
| 3,903,942 | 9/1975 | Vest | 141/331 |

*Primary Examiner*—Houston S. Bell, Jr.
*Attorney, Agent, or Firm*—J. Edward Hess; Donald R. Johnson

[57] ABSTRACT

An adapter in the form of a sleeve which is permanently mounted inside the gasoline tank fillpipe of an automobile provides reaction points which maintain the spout of a gasoline dispensing nozzle with its axis approximately collinear with the fillpipe axis, when the spout is inserted into the gasoline tank for dispensing. The adapter insert (sleeve) has therein a sealing member which covers the air duct of the conventional automatic dispensing nozzle, thus preventing operation of the nozzle when the nozzle spout is inserted to less than a certain extent into the sleeve.

10 Claims, 5 Drawing Figures

GASOLINE TANK FILLPIPE ADAPTER

BACKGROUND OF THE INVENTION

This invention relates to the dispensing of gasoline into the gasoline tanks of automobiles, and more particularly to an adapter (insert) useful for the dispensing of gasoline into automobile gasoline tanks while simultaneously recovering vapors therefrom by means of direct displacement.

Several so-called "vapor-tight-fill" devices have been developed, for making a seal between a automobile gasoline tank fillpipe and a gasoline dispensing nozzle. One such device is disclosed in my U.S. Pat. No. 3,566,928.

The device of my prior patent (which may be termed a "vapor recovery boot") and others that make a face seal against the fillpipe, do not always make a tight seal, because of the steep angle formed between the nozzle spout and the fillpipe. This steep angle comes about because the nozzle is retained in the fillpipe by rocking, which is to say that it rests on the bottom of the fillpipe and has a reaction point at the top of the pipe. With the I.D. of the fillpipe being typically 2¼ inches and the spout I.D. being 15/16 inches (standard diameter), the angle between the nozzle spout and the fillpipe can be quite sharp. When such an angle comes into play, the sealing surface of the vapor recovery boot (which is intended to make a flat face seal against the outer end of the fillpipe is pushed down, thus breaking the seal at the lower edge of the boot.

It will be appreciated that, if a tight seal between the fillpipe and the dispensing nozzle is not made, the vapors cannot be recovered effectively, so that the purposes of the vapor recovery (to wit, the prevention of air pollution and the limination of the fire hazard) will be defeated.

An object of this invention is to provide a device, for automobile gasoline tank fillpipes, which cooperates with the spout of a dispensing nozzle to ensure that a tight seal will always be made between the nozzle and the fillpipe.

Another object is to provide an adapter, for gasoline tank fillpipes, which cooperates in a novel manner with a gasoline dispensing nozzle.

A further object is to provide a device for gasoline tank fillpipes which cooperates with a gasoline dispensing nozzle and the fillpipe, but also to prevent the nozzle from operating until the nozzle spout is fully and properly inserted into the fillpipe.

A still further object is to provide a device for gasoline tank fillpipes which cooperates with a gasoline dispensing nozzle to maintain the nozzle spout in an optimum position relative to the fillpipe, when the nozzle is inserted into the fillpipe.

SUMMARY OF THE INVENTION

In accordance with the invention, vapor losses to the atmosphere attendant to dispensing gasoline into the fillpipe of an automobile are reduced by placing an adapter in the fillpipe to cooperate with an automatic gasoline dispensing, vapor recovery nozzle. The adapter has a cylindrical sleeve dimensioned to be mounted inside the fillpipe and to receive and hold the spout of the dispensing nozzle with its axis approximately colinear with the fillpipe axis. This permits a sealing assembly on the nozzle to mate with the mount of the fillpipe. The adapter also has a sealing member within the sleeve to cover the controlling port of the nozzle to prevent nozzle operation until it is fully inserted in the fillpipe.

BRIEF DESCRIPTION OF THE DRAWINGS

A detailed description of the invention follows, taken in conjunction with the accompanying drawings, wherein.

DETAILED DESCRIPTION OF THE INVENTION

Figures 1, 2:
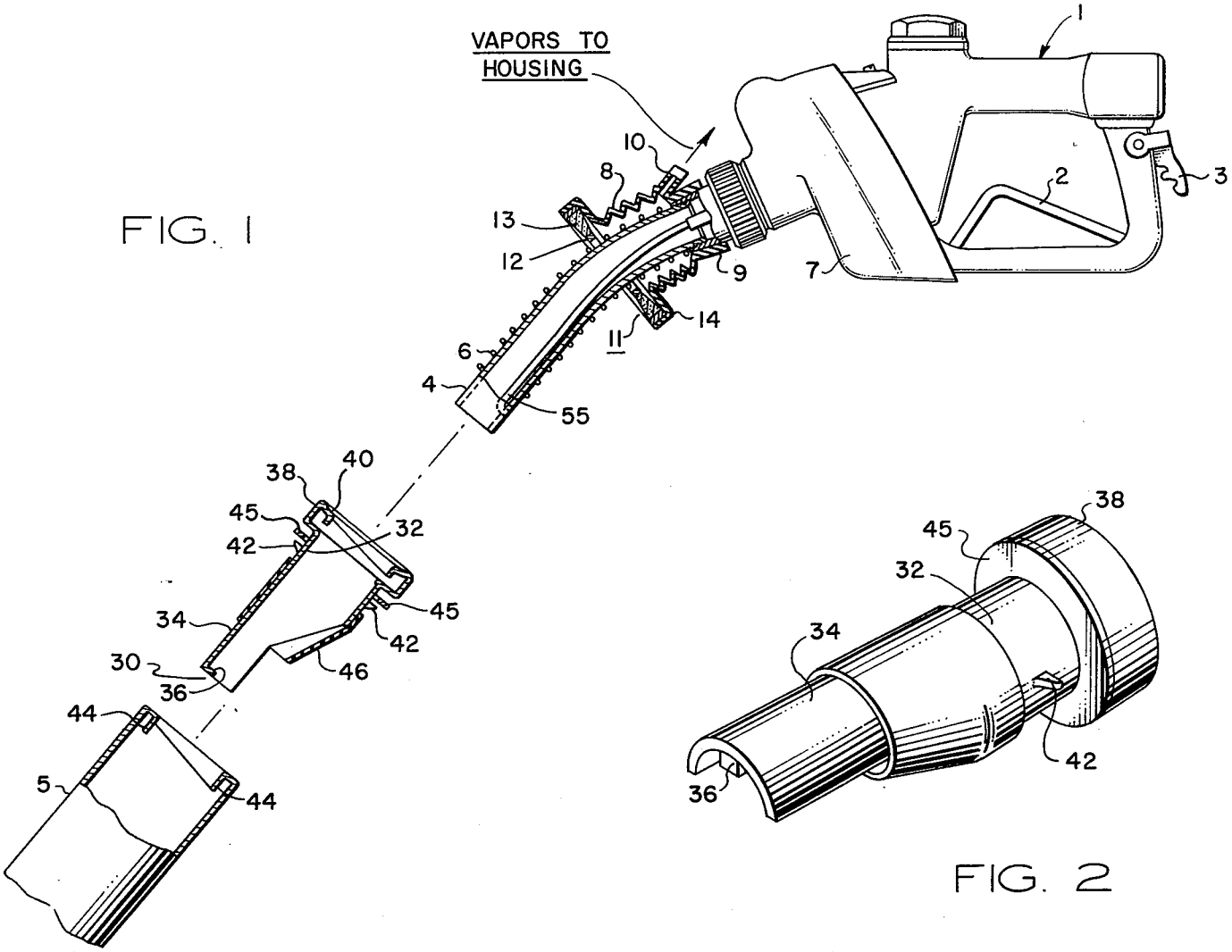
FIG. 1 is an exploded elevational and cross-sectional view of an automobile gasoline tank fillpipe, a fillpipe adapter according to the invention and a dispensing nozzle having a vapor seal.
FIG. 2 is a perspective view of the fillpipe adapter.

Referring now to FIG. 1, a gasoline dispensing nozzle 1, of a type widely used in the industry is shown ready for insertion into an automobile gasoline fillpipe 5 in which a fillpipe adapter 30 is to be positioned. The nozzle 11 is adapted to be connected to the outer end of a dispensing hose (not shown). The nozzle 1 has the usual pivotally mounted lever 2 for operating a shut-off valve (not shown) which is located in the nozzle body, and also has a conventional pivotally mounted, spring-biased clip 3 which coacts with lever 2 to provide an arrangement for holding the shutoff valve open without the necessity of manually holding lever 2 in its "open" position. A dischage spout 4 is provided on nozzle 1, opposite the hose connection to the nozzle, this spout having a somewhat curved outer configuration such that it is readily insertable into the metallic fillpipe 5 of a motor vehicle fuel tank (not shown). Inside spout 4 is a vacuum-operated, automatic shut-off tube 44, which opens to the exterior near the lower end of spout 4. When tube 44 is covered, as by gasoline when the tank is full, gasoline dispenstion is automatically shut off to prevent spills by overfilling. The usual resilient clamp wire 6, wound around the outside of spout 4, assists in holding the nozzle spout in the fillpipe 5. Also, the usual soft, impact-absorbing rubber cover 7 is provided on the forward end of the body of nozzle 1. In FIG. 1, only the upper end of the fillpipe is shown.

A flexible bellows 8, made of a soft elastometric or rubber-like synthetic material which is unaffected by gasoline, surrounds the spout 4 at the upper end therof, adjacent the point of attachment of this spout to the nozzle proper.

At its upper end, the elongated hollow member, or bellows, 8 has an integral cylindrical portion or collar 9 which is adhesively or otherwise suitably secured in a vaportight manner to the outer cylindrical surface of the spout 4. The upper end of the bellows could be secured to or made integral with the lower end of the rubber cover 7.

At or near its upper end the bellows 8 is provided with a tubular coupling 10 to which the outer end of a tube or hose (not shown) may be attached, for abstracting vapors from the interior of the bellows.

One face of a composite essentially flat annular or ring-shaped sealing assembly 11 is secured in vaportight fashion (adhesively, or in other suitable manner) to the lower end of bellows 8. The assembly 11 consists of three separate elements secured together in a concentric arrangement, an inner pole piece 12 of a low-carbon steel, an intermediate element 13 of the material commonly known as "magnetic rubber", and an outer pole piece 14 of a low carbon steel. The elements 12-14 are all annular or ring-shaped, with the inner cylindrical wall of element 13 secured to the outer cylindrical wall of element 12, and with the outer cylindrical wall of element 13 secured to the inner cylindrical wall of element 14. The ID of element 12 is greater than the OD of spout 4, thus providing an annular space around the outside of this spout; this space provides a passage for vapors from the fillpipe 5 into the lower end of bellows 8. The axial length of the outer pole piece 14 is preferably greater than that of the inner pole piece 12, and the radial width of pole piece 14 is preferably somewhat less than that of pole piece 12.

The material from which element 13 is made is rubber-like and contains embedded magnetic particles, so as to render the element as a whole magnetic.

In use, when the spout 4 is inserted down into the fillpipe 5 and adapter 30, the inherent resiliency of the bellows 8 provides enough downwardly acting force to position the sealing assembly 11 in contact with the mouth of the fillpipe 5. The magnetic attractive forces between the magnetic element 13 and the metallic fillpipe 5 then provides the force to assist in making a flat face vaportight seal against the outer end of the fillpipe, thus forcing vapors which issue from this end of the fillpipe to travel through the annular space between the spout 4 and the inner diameter of element 12, into the interior or bellows 8. It may be noted here that the interior of bellows 8 is thus coupled to the fillpipe 5.

The ferromagnitic pole pieces 12 and 14 greatly enhance the strength of the magnetic attractive forces between the magnetic element 13 and the outer end of the metallic fillpipe 5.

As gasoline is used from a motor vehicle fuel tank, the empty space created in the tank by withdrawing gasoline fills with gasoline vapors that are generally in thermodynamic equilibrium with the liquid gasoline phase remaining in the tank. When the tank is refilled with gasoline by way of nozzle 1 and spout 4, these vapors are forced out of the tank and travel upwardly in fillpipe 5, to its upper end. These displaced vapors are forced to travel around the outside of spout 4 into the bellows 8, because of the vaportight seal between the outer end of fillpipe 5 and assembly 11. The displaced vapors are collected in the bellows 8 and are sent back to the housing of the gasoline dispensing apparatus through a hose which is strapped to the normal gasoline delivery hose and is connected at its outer end to the coupling 10 at the upper end of the bellows.

At the dispensing apparatus housing, the vapors can either be condensed and the condensate then fed into the dispensing hose, or they can be returned to the underground gasoline storage tanks by a suitable piping arrangement.

Adapter 30 is constructed as a sleeve having a cylindrical end 32 whose outer diameter is small enough to fit inside gasoline fillpipe 5 and whose inner diameter is large enough to receive gasoline dispensing nozzle spout 4, and preferably much larger than the diameter of spout 4. Adapter 30 has a semi-cylindrical end 34 inside the fillpipe on the upper side of the sleeve to prevent upward movement of spout 4 when it is inserted into fillpipe 5. End 34 holds spout 5 with its axis approximately colinear with the axis of fillpipe 5 to prevent breaking of the seal between fillpipe 5 and sealing assembly 11. End 34 has at its lowermost end a stop 36 to limit the distance that spout 4 may be inserted into fillpipe 5.

Figure 3A:
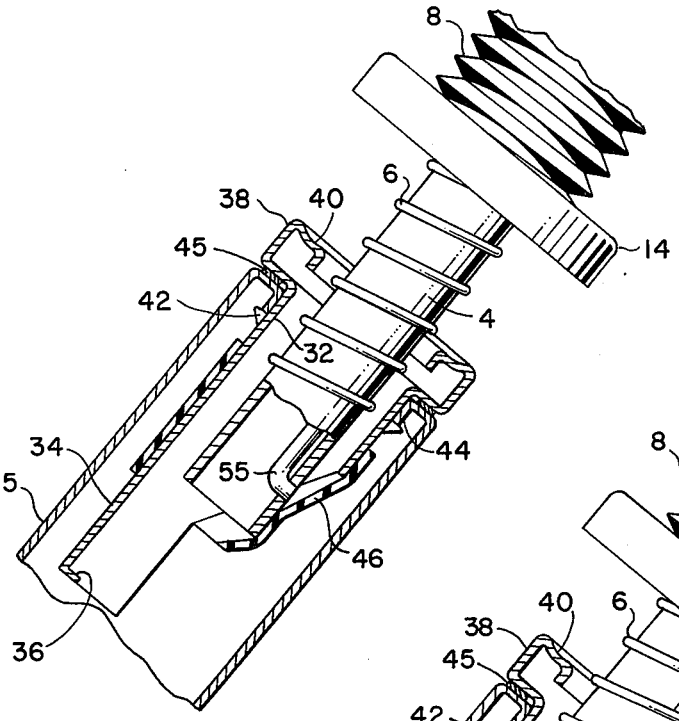
FIGS. 3A, 3B, 3C show the fillpipe adapter positioned in the fillpipe and the dispenser nozzle at various degrees of insertion in the fillpipe.

Adapter 30 has attached to cylindrical sleeve end 32 at its upper end a sealing assembly 38 having a diameter larger than the inner diameter of the fillpipe to limit the distance that the adapter may be inserted into the fillpipe (see FIG. 3A). Sealing assembly 38 has a sealing surface 40 on its outer side to seal against sealing assembly 11 on nozzle 1. The adapter is secured inside fillpipe 5 by tabs 42 which ride against flange 44 of the fillpipe. The tabs may be similar to the tabs that are customarily used to secure a cap onto the fillpipe.

Figure 3B:
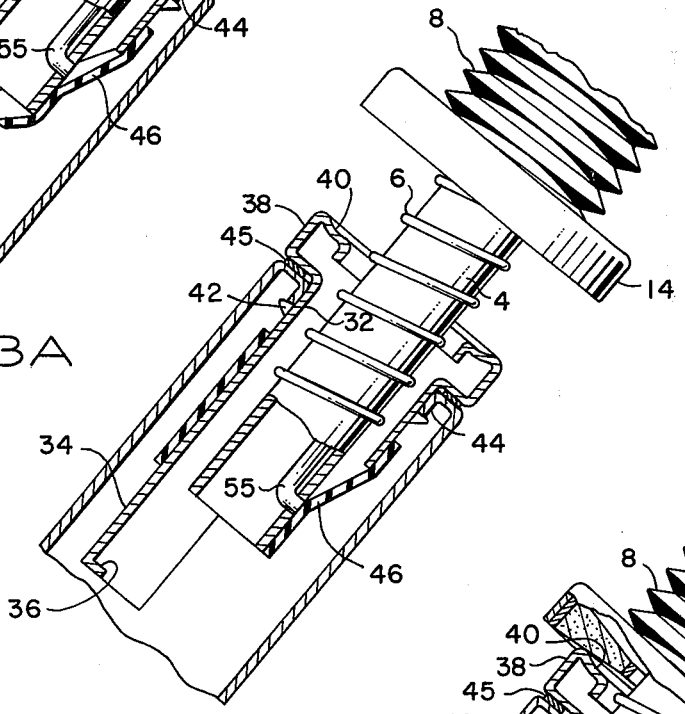
Figure 3C:
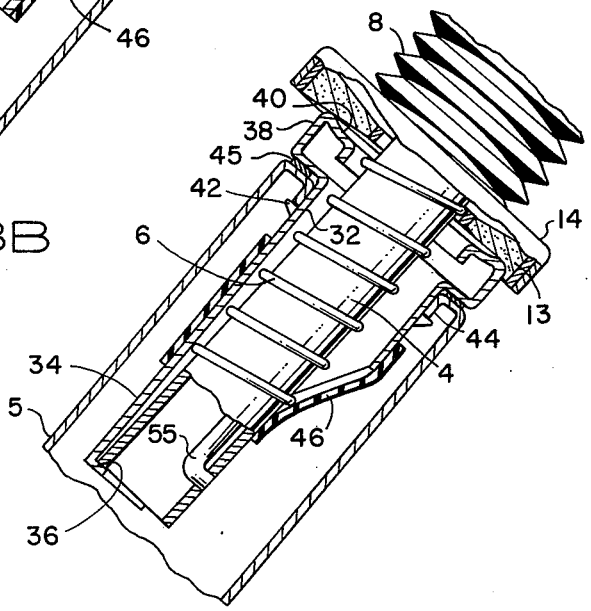

The adapter is fitted with an elastic seal 46 which wraps around both cylindrical end 32 and semi-cylindrical end 34. Seal 46 covers tube 55 as it is inserted into the fillpipe (see FIGS. 3A and 3B) to prevent dispensation of gasoline. The seal has a restricted length so that tube 55 will be uncovered to allow gasoline dispensation when the spout is fully inserted into the adapter (see FIG. 3C).

While particular embodiments of the invention have been shown and described, it is obvious that changes and modifications may be made therein without departing from the true scope and spirit of the invention. It is the intention in the appended claims to cover all such changes and modifications.

What is claimed is:

1. An automobile gasoline tank fillpipe adapter for cooperation with an automatic gasoline dispensing nozzle which has a spout of standard diameter with a port therein for controlling the operation of the nozzle valve shutoff mechanism, the adapter being designed to be inserted within a gasoline tank fillpipe and comprising: a rigid cylindrical sleeve dimensioned to be mounted inside a gasoline tank fillpipe and having an inner diameter such as to receive the spout of a gasoline dispensing nozzle with the upper side of the rigid sleeve extending along a substantial portion of the length of a nozzle spout to prevent upward movement of a nozzle spout inserted in the adapter and to hold the spout with its axis approximately colinear with the fillpipe axis; means for securing said sleeve in position in the outer end of said fillpipe, and a sealing member supported by said sleeve adapted to cover the controlling port of a gasoline dispensing nozzle when the spout thereof is being inserted into said sleeve and to leave said port open when said nozzle is fully inserted into said fillpipe.

2. Adapter according to claim 1, wherein the inner diameter of the fillpipe is large as compared to the diameter of the nozzle spout.

3. Adapter of claim 1, including also means providing a sealing surface on the outer end of said sleeve adapted to seal against a vapor recovery device carried by the gasoline dispensing nozzle.

4. Adapter of claim 1 further including a stop on the lower end of said sleeve to restrict travel of said nozzle into said fillpipe.

5. A combination for use in filling an automobile gasoline tank through a fillpipe, comprising: an automobile gasoline dispensing nozzle having a spout of standard diameter with a port therein for controlling the operation of the nozzle valve shutoff mechanism; a rigid cylindrical sleeve dimensioned to be mounted inside the gasoline tank fillpipe with the upper side of the rigid sleeve extending along a substantial portion of the length of a nozzle spout to prevent upward movement of a nozzle spout inserted in the adapter and to hold the spout with its axis approximately colinear with the fillpipe axis, means for mounting said rigid sleeve in the outer end of said fillpipe, and a sealing member supported by said sleeve for covering the controlling port of said nozzle when the spout thereof is being inserted in said sleeve and to leave said controlling port open when said nozzle is fully inserted in said fillpipe.

6. Combination of claim 5, including also a vapor receiving chamber carried by said nozzle, and means on the outer end of said sleeve providing a sealing surface adapted to seal against said chamber.

7. Combination defined in claim 5, including also a vapor receiving chamber carried by said nozzle, and means on the outer end of said sleeve providing a sealing surface adapted to seal against said chamber.

8. Apparatus for mating an automobile gasoline fillpipe to a gasoline dispensing nozzle having a nozzle spout with a port therein for controlling a nozzle shutoff mechanism and a vapor seal for covering the mouth of the fillpipe when the nozzle is inserted therein, comprising: a rigid sleeve coaxially positioned inside the fillpipe to receive the nozzle with the upper side of the rigid sleeve extending along a substantial portion of the length of a nozzle spout to prevent upward movement of a nozzle spout inserted in the adapter and to hold the nozzle spout with its axis approximately colinear with the fillpipe axis, said rigid sleeve having a cylindrical end near the mount of said fillpipe and a semi-cylindrical end on the upper side of said sleeve inside said fillpipe; and an elastic sealing member over a portion of the semi-cylindrical end of the sleeve and adjacent the cylindrical end of said sleeve sized to cover the port of the nozzle when the spout is being inserted into said sleeve and to leave said port open when the vapor seal covers the mouth of the fillpipe.

9. The apparatus of claim 8 further including a sealing member of the outer end of the sleeve to seal against the vapor seal on the nozzle.

10. The apparatus of claim 8 further including a stop on the lower end of said sleeve to restrict travel of said nozzle into said fillpipe.

* * * * *